US010816312B2

(12) United States Patent
Yang et al.

(10) Patent No.: US 10,816,312 B2
(45) Date of Patent: Oct. 27, 2020

(54) INTEGRATED HOLE SEALING DEVICE FOR LOOSENING BLASTING AND WATER INJECTION OF UNDERGROUND DEEP HOLE

(71) Applicants: China University of Mining and Technology, Jiangsu (CN); XUZHOU BOAN SCIENCE & TECHNOLOGY DEVELOPMENT CO., LTD, Jiangsu (CN)

(72) Inventors: Wei Yang, Jiangsu (CN); Baiquan Lin, Jiangsu (CN); Changzheng Lu, Jiangsu (CN); Ru Jia, Jiangsu (CN); Minghua Lin, Jiangsu (CN)

(73) Assignees: China University of Mining and Technology, Jiangsu (CN); XUZHOU BOAN SCIENCE & TECHNOLOGY DEVELOPMENT CO., LTD, Jiangsu (CN)

( * ) Notice: Subject to any disclaimer, the term of this patent is extended or adjusted under 35 U.S.C. 154(b) by 0 days.

(21) Appl. No.: 16/632,883

(22) PCT Filed: Oct. 29, 2018

(86) PCT No.: PCT/CN2018/112289
§ 371 (c)(1),
(2) Date: Jan. 22, 2020

(87) PCT Pub. No.: WO2019/210657
PCT Pub. Date: Nov. 7, 2019

(65) Prior Publication Data

US 2020/0182597 A1 Jun. 11, 2020

(30) Foreign Application Priority Data

May 4, 2018 (CN) ..... 2018 1 0420331

(51) Int. Cl.
*F42D 1/18* (2006.01)
*E21B 33/127* (2006.01)
(Continued)

(52) U.S. Cl.
CPC ..... *F42D 1/18* (2013.01); *E21B 33/127* (2013.01); *E21B 34/06* (2013.01); *E21C 37/00* (2013.01)

(58) Field of Classification Search
CPC ..... F42D 1/18; E21B 33/127; E21B 34/06; E21C 37/00
(Continued)

(56) References Cited

U.S. PATENT DOCUMENTS 4,349,047 A * 9/1982 Ditto ..... E21B 33/127 138/89
4,449,584 A * 5/1984 Christensen ..... E21B 33/127 134/91
(Continued)

FOREIGN PATENT DOCUMENTS

CN 201671653 12/2010
CN 103899270 7/2014
(Continued)

OTHER PUBLICATIONS

"International Search Report (Form PCT/ISA/210) of PCT/CN2018/112289", dated Jan. 30, 2019, with English translation thereof, pp. 1-4.

*Primary Examiner* — Samir Abdosh
(74) *Attorney, Agent, or Firm* — JCIPRNET

(57) ABSTRACT

An integrated hole sealing, device includes a capsule plug, an outer capsule having a first hole site, an inner capsule having a second hole site, a capsule water injection pipe, a borehole water injection pipe and a tapered plug. Two ends of the outer capsule and the inner capsule are respectively
(Continued)

fixed on the capsule plug and the tapered plug. The capsule plug, the tapered plug, the outer capsule and the inner capsule form a closed hollow cylindrical cavity. A middle part of the inner capsule is a hollow pipeline, and two ends thereof respectively correspond to the first and second hole sites. The borehole water injection pipe passes through the hollow cylindrical cavity. A part, located in the hollow cylindrical cavity, of the borehole water injection pipe is telescopically wound outside the inner capsule. The capsule water injection pipe passes through the capsule plug and extends into the hollow cylindrical cavity.

12 Claims, 3 Drawing Sheets

(51) Int. Cl.
*E21B 34/06* (2006.01)
*E21C 37/00* (2006.01)

(58) Field of Classification Search
USPC ..... 102/333
See application file for complete search history.

(56) References Cited

U.S. PATENT DOCUMENTS 4,660,644 A * 4/1987 Egnor ..... E21B 33/1277 102/333
4,913,233 A * 4/1990 Fitzgibbon, Jr. ..... E21B 33/127 102/313
2019/0003811 A1* 1/2019 Ma ..... F42D 1/00

FOREIGN PATENT DOCUMENTS

| | | |
|---|---|---|
| CN | 106639962 | 5/2017 |
| CN | 107676092 | 2/2018 |
| RU | 2196221 | 1/2003 |
| WO | 2016105388 | 6/2016 |

* cited by examiner

INTEGRATED HOLE SEALING DEVICE FOR LOOSENING BLASTING AND WATER INJECTION OF UNDERGROUND DEEP HOLE

CROSS-REFERENCE TO RELATED APPLICATION

This application is a 371 of international application of PCT application serial no. PCT/CN2018/112289, filed on Oct. 29, 2018, which claims the priority benefit of China application no. 201810420331.9, filed on May 4, 2018. The entirety of each of the above mentioned patent applications is hereby incorporated by reference herein and made a part of this specification.

BACKGROUND

Technical Field

The present invention relates to mining equipment, and particularly relates to an integrated hole sealing device for loosening blasting and water injection of underground deep hole.

Description of Related Art

Most coal seams in coal mining in China belong to the permo-carboniferous period and have large gas content, low breathability and complicated geological structure. During mining, a large gas emission amount, complicated geological conditions for mining a coal seam, expansion of the mining scale and increase of the mining intensification degree lead to more complicated and changeable changes in a mining-induced stress field, a coal-rock fracture field and a gas flowing field. The original safety technique and theory are difficult to adapt to the urgent needs for safe and efficient production of current coal mines. Under the complicated conditions, it is more likely to induce outburst of coal and gas and sudden gushing of gas, thereby causing gas accidents.

At present, a loosening blasting method is adopted in China to improve the mechanical properties of a coal body, release the ground stress to enable a stress peak to be pushed to a deeper position, and then suppress adsorption and desorption of gas through coal seam water injection, thereby realizing comprehensive prevention and treatment of the outburst of the coal and gas from three aspects: reducing the ground stress, reducing the gas pressure and increasing the mechanical strength of a coal seam. However, at present, yellow sand is used for sealing holes underground, which is high in labor intensity of workers and not satisfactory in sealing effect. Chinese Patent Application CN201710243106.8 discloses a blocking device which seals a hole by injecting water into a capsule to expand the capsule. This hole sealing capsule is only suitable for treatment such as gas injection displacement or hydraulic pressure, and is easily damaged in blasting since a front end of the capsule is lacking in protection when the capsule is applied to loosening blasting. The water-expanded capsule has both lateral expansion and longitudinal expansion during expansion. In the case of the longitudinal expansion, pipelines inside the capsule are easily broken.

SUMMARY

The present invention is directed to an integrated hole sealing device for underground deep hole hydraulic loosening blasting or underground coal seam water injection, so as to realize integrated convenient operation of hole sealing, water injection and blasting.

In order to achieve the above invention objective, the technical solution of the present invention is listed as follows.

An integrated hole sealing device for loosening blasting and water injection of underground deep hole includes a capsule plug, an outer capsule, an inner capsule, a capsule water injection pipe, a borehole water injection pipe and a tapered plug. Two ends of the outer capsule and two ends of the inner capsule are respectively fixed on the capsule plug and the tapered plug. The capsule plug, the tapered plug, the outer capsule and the inner capsule form a closed hollow cylindrical cavity. A middle part of the capsule plug is provided with a first hole site, and a middle part of the tapered plug is provided with a second hole site. A middle part of the inner capsule is a hollow pipeline, and two ends of the hollow pipeline respectively correspond to the first hole site and the second hole site. The borehole water injection pipe passes through the hollow cylindrical cavity, and two ends of the borehole water injection pipe respectively pass through a top end of the capsule plug and a top end of the tapered plug. A part, located in the hollow cylindrical cavity, of the borehole water injection pipe is telescopically wound on an outer side of the inner capsule. The capsule water injection pipe passes through the capsule plug and extends into the hollow cylindrical cavity.

Further, each of the outer capsule and the inner capsule consists of a capsule outer sleeve, a steel wire layer and a capsule inner container. The steel wire layer is located between the capsule outer sleeve and the capsule inner container. The capsule outer sleeve of the outer capsule is located on an outer layer of the outer capsule, and the capsule outer sleeve of the inner capsule is located on an inner layer of the inner capsule.

Further, a first valve is arranged on the capsule water injection pipe, and a second valve is arranged on the borehole water injection pipe. The first valve and the second valve are both located on an outer side of the capsule plug. The first valve and the capsule water injection pipe are detachably connected, and the second valve and the borehole water injection pipe are detachably connected.

Further, a booster is fixed on the outer side of the capsule plug.

Further, the above integrated hole sealing device for loosening blasting and water injection of underground deep hole further includes an explosive wire tube. The wire tube is a steel tube. The explosive wire tube passes through the hollow pipeline. One end of the explosive wire tube extends out of the integrated hole sealing device for loosening blasting and water injection of underground deep hole, and the other end of the explosive wire tube is connected with an explosive cartridge. A part, extending to the outer side of the capsule plug, of the explosive wire tube is provided with a third valve. The third valve and the explosive wire tube are detachably connected.

Compared with the prior art, the present invention has the beneficial effects that a front end of the integrated hole sealing device for loosening blasting and water injection of underground deep hole of the present invention is the tapered plug, so that a capsule of the integrated hole sealing device for loosening blasting and water injection of underground deep hole enters a borehole favorably. The tapered plug disperses energy generated by loosening blasting to protect the capsule from being damaged by the loosening blasting. The borehole water injection pipe spirally wound in the hollow cylindrical cavity telescopically stretches in the hollow cylindrical cavity, so that the borehole water injection pipe is prevented from being broken during water injection expansion of the hollow cylindrical cavity. The integrated hole sealing device for loosening blasting and water injection of underground deep hole of the present invention is ingenious in structure, is independently used for underground coal seam water injection and is also used cooperatively with a blasting device to realize integration of placement, hole sealing, water injection and blasting, and is easy to operate and high in working efficiency.

DESCRIPTION OF THE EMBODIMENTS

The present invention is further described below with reference to the drawings.

Embodiment

Figure 1:
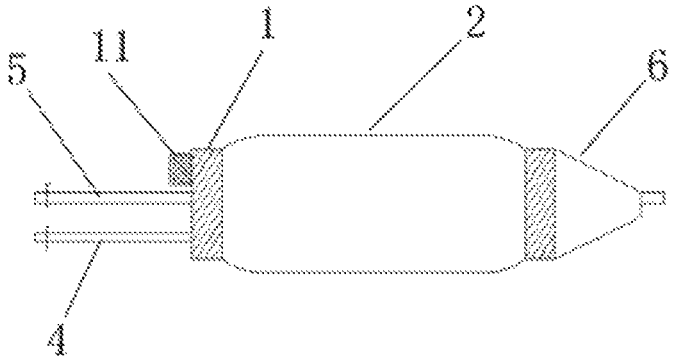
FIG. 1 is a schematic diagram of an external structure of an integrated hole sealing device for loosening blasting and water injection of underground deep hole in an embodiment of the present invention.
Figure 2:
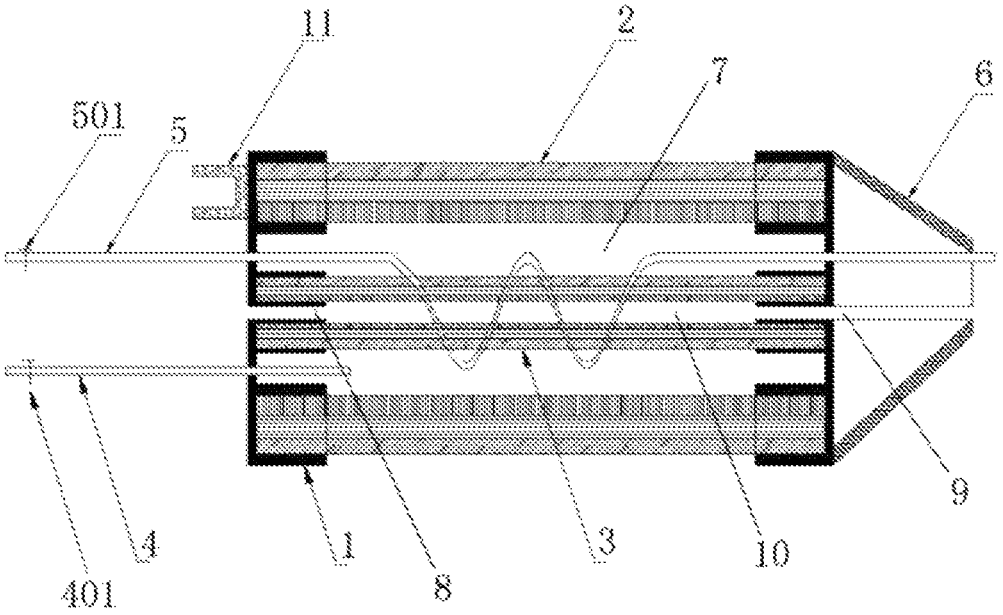
FIG. 2 is a sectional view of the integrated hole sealing device for loosening blasting and water injection of underground deep hole in the embodiment of the present invention.

As shown in FIG. 1 and FIG. 2, an integrated hole sealing device is adapted for loosening blasting and water injection of an underground deep hole. The integrated hole sealing device includes a capsule plug 1, an outer capsule 2, an inner capsule 3, a capsule water injection pipe 4, a borehole water injection pipe 5 and a tapered plug 6. Two ends of the outer capsule 2 and two ends of the inner capsule 3 are respectively fixed on the capsule plug 1 and the tapered plug 6. The capsule plug 1, the tapered plug 6, the outer capsule 2 and the inner capsule 3 form a closed hollow cylindrical cavity 7. A middle part of the capsule plug 1 is provided with a first hole site 8, and a middle part of the tapered plug 4 is provided with a second hole site 9. A middle part of the inner capsule 3 is a hollow pipeline 10, and two ends of the hollow pipeline 10 respectively correspond to the first hole site 8 and the second hole site 9. The borehole water injection pipe 5 passes through the hollow cylindrical cavity 7, and two ends of the borehole water injection pipe 5 respectively pass through a top end of the capsule plug 1 and a top end of the tapered plug 6. A part, located in the hollow cylindrical cavity 7, of the borehole water injection pipe 5 is telescopically wound on an outer side of the inner capsule 3. The capsule water injection pipe 4 passes through the capsule plug 1 and extends into the hollow cylindrical cavity 7. A booster 11 is fixed on an outer side of the capsule plug 1.

Figure 3:
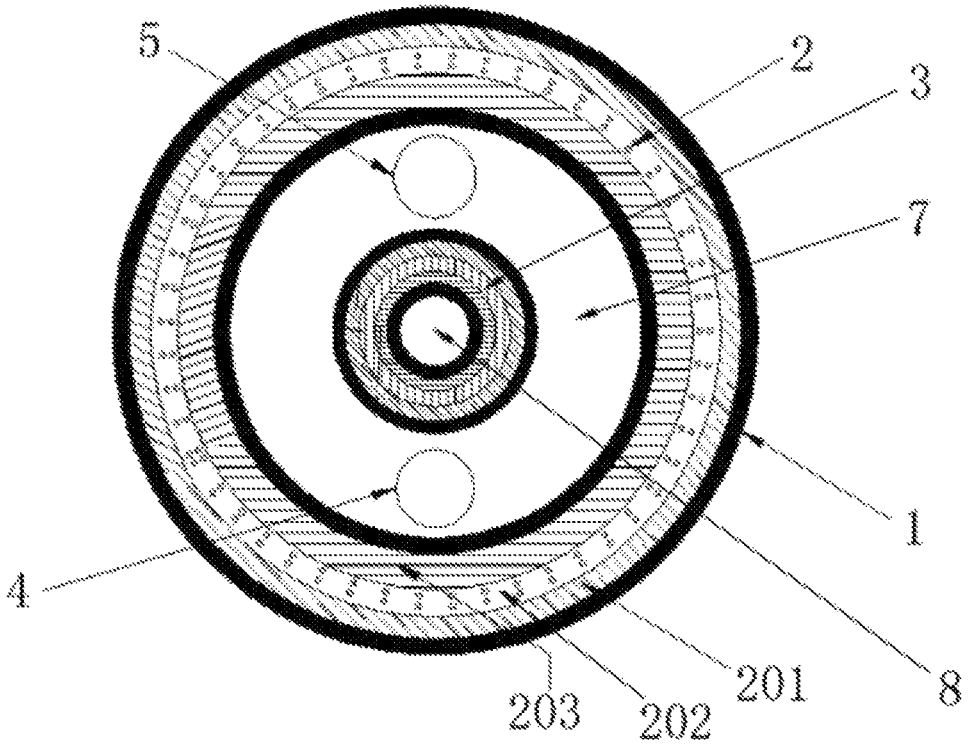
FIG. 3 is a cross-sectional view of a capsule plug in the embodiment of the present invention.
Figure 4:
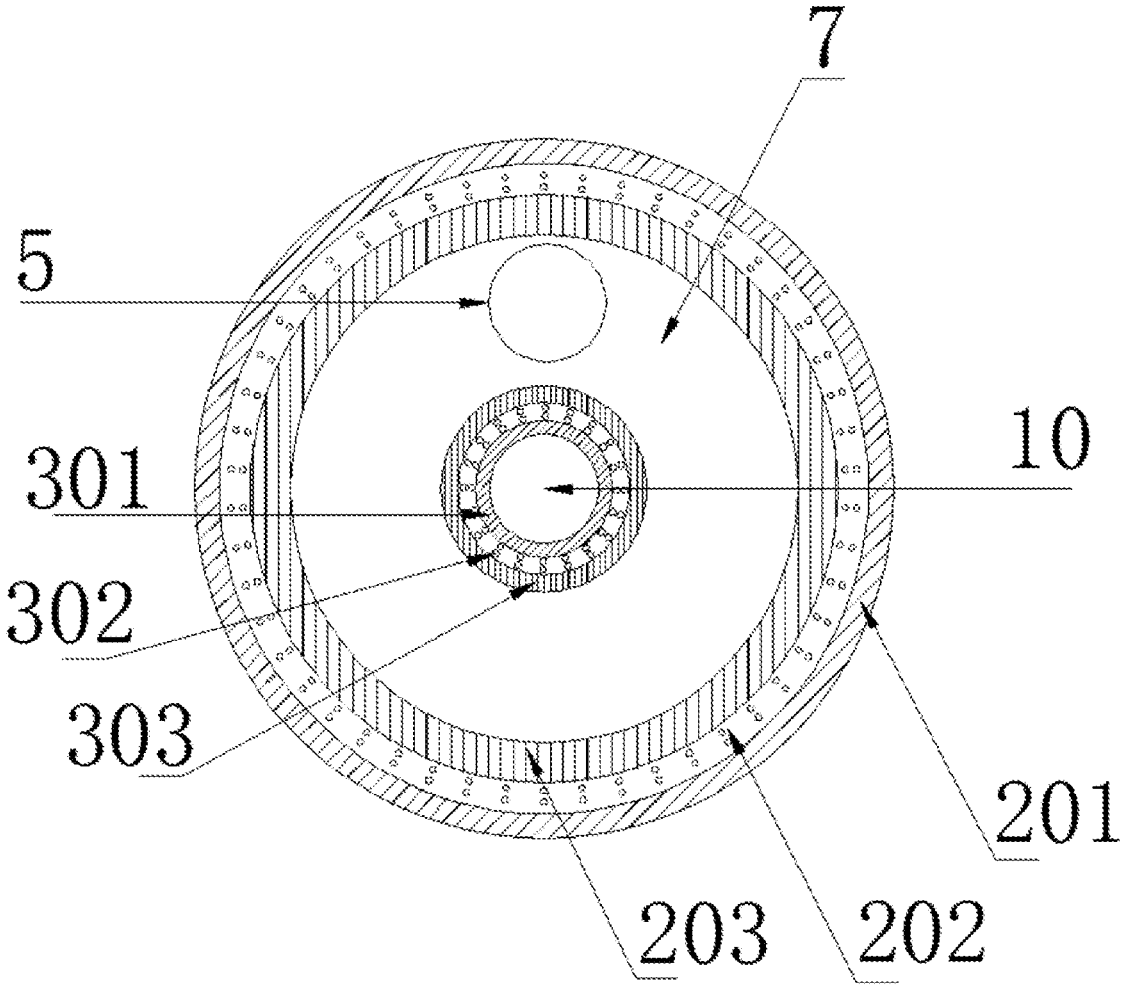
FIG. 4 is a cross-sectional view of a middle part of the integrated hole sealing device for loosening blasting and water injection of underground deep hole in the embodiment of the present invention.

As shown in FIG. 3 and FIG. 4, each of the outer capsule 2 and the inner capsule 3 consists of a capsule outer sleeve 201, 301, a steel wire layer 202, 302 (202, 302) and a capsule inner container 203, 303. The steel wire layer 202 is located between the capsule outer sleeve 201 and the capsule inner container 203, and the steel wire layer 302 is located between the capsule outer sleeve 301 and the capsule inner container 303. The capsule outer sleeve 201 of the outer capsule 2 is located on an outer layer of the outer capsule 2, and the capsule outer sleeve 301 of the inner capsule 3 is located on an inner layer of the inner capsule 3.

A first valve 401 is arranged on the capsule water injection pipe 4, and a second valve 501 is arranged on the borehole water injection pipe 5. The first valve 401 and the second valve 501 are both located on the outer side of the capsule plug 1. The first valve 401 and the capsule water injection pipe 4 are in screwed, inserted or flange connection, and the second valve 501 and the borehole water injection pipe 5 are in screwed, inserted or flange connection.

When underground coal seam water injection is performed, the integrated hole sealing device for loosening blasting and water injection of underground deep hole is firstly conveyed to a pre-sealing section of a borehole by the booster 11. The first valve 401 is opened to inject water into the hollow cylindrical cavity 7 through the capsule water injection pipe 4, and then the hollow cylindrical cavity 7 is expanded. The inner capsule 3 is contracted to close the hollow pipeline 10, and the outer capsule 2 is expanded to block the borehole, and then the first valve 401 is closed, and the second valve 501 is opened, so as to inject water into coal seams around the borehole through the borehole water injection pipe 5.

When deep hole hydraulic loosening blasting is performed, an explosive cartridge is firstly placed at a predetermined loosening blasting point in the borehole, and then an explosive wire of the explosive cartridge is placed into a steel tube to prevent the explosive wire from being short-circuited by water. The steel tube passes through the second hole site 9, the hollow pipeline 10 and the first hole site 8 and then extends out of the borehole. A part, extending to the outer side of the capsule plug 1, of the steel tube is provided with a third valve, and the third valve and the steel tube are in screwed or inserted connection. The underground deep hole loosening blasting and water injection integrated hole sealing device is conveyed to the pre-sealing section in the borehole by the booster 11. The first valve 401 is opened to inject water into the hollow cylindrical cavity 7 through the capsule water injection pipe 4. The inner capsule 3 is contracted to inclasp the steel tube, and the outer capsule 2 is expanded to block the borehole. The first valve 401 is closed, and the second valve 501 is opened to inject water into the borehole. After the water injection is completed, the second valve 501 is closed, and the explosive cartridge is detonated. After the explosive cartridge is exploded, the third valve is mounted on the explosive wire tube, the third valve is closed to block the steel tube, and the second valve 501 is opened to inject water into the borehole again till no more water is injected into the borehole.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An integrated hole sealing device for loosening blasting and water injection of underground deep hole, the integrated hole sealing device comprising a capsule plug, an outer capsule, an inner capsule, a capsule water injection pipe, a borehole water injection pipe and a tapered plug, wherein two ends of the outer capsule and two ends of the inner capsule are respectively fixed on the capsule plug and the tapered plug; the capsule plug, the tapered plug, the outer capsule and the inner capsule form a closed hollow cylindrical cavity;

a middle part of the capsule plug is provided with a first hole site, and a middle part of the tapered plug is provided with a second hole site; a middle part of the inner capsule is a hollow pipeline, and two ends of the hollow pipeline respectively correspond to the first hole site and the second hole site;

the borehole water injection pipe passes through the hollow cylindrical cavity, and two ends of the borehole water injection pipe respectively pass through a top end of the capsule plug and a top end of the tapered plug; a part, located in the hollow cylindrical cavity, of the borehole water injection pipe is telescopically wound on an outer side of the inner capsule; and the capsule water injection pipe passes through the capsule plug and extends into the hollow cylindrical cavity.

2. The integrated hole sealing device for loosening blasting and water injection of underground deep hole according to claim 1, wherein each of the outer capsule and the inner capsule consists of a capsule outer sleeve, a steel wire layer and a capsule inner container; the steel wire layer is located between the capsule outer sleeve and the capsule inner container; the capsule outer sleeve of the outer capsule is located on an outer layer of the outer capsule, and the capsule outer sleeve of the inner capsule is located on an inner layer of the inner capsule.

3. The integrated hole sealing device for loosening blasting and water injection of underground deep hole according to claim 1, wherein a first valve is arranged on the capsule water injection pipe, and a second valve is arranged on the borehole water injection pipe; and the first valve and the second valve are both located on an outer side of the capsule plug.

4. The integrated hole sealing device for loosening blasting and water injection of underground deep hole according to claim 3, wherein the first valve and the capsule water injection pipe are detachably connected.

5. The integrated hole sealing device for loosening blasting and water injection of underground deep hole according to claim 3, wherein the second valve and the borehole water injection pipe are detachably connected.

6. The integrated hole sealing device for loosening blasting and water injection of underground deep hole according to claim 1, wherein a booster is fixed on an outer side of the capsule plug.

7. The integrated hole sealing device for loosening blasting and water injection of underground deep hole according to claim 1, integrated hole sealing device further comprising an explosive wire tube, wherein the explosive wire tube passes through the hollow pipeline and extends to an outer side of the capsule plug.

8. The integrated hole sealing device for loosening blasting and water injection of underground deep hole according to claim 7, wherein a part, extending to the outer side of the capsule plug, of the explosive wire tube is provided with a third valve.

9. The integrated hole sealing device for loosening blasting and water injection of underground deep hole according to claim 8, wherein the third valve and the explosive wire tube are detachably connected.

10. The integrated hole sealing device for loosening blasting and water injection of underground deep hole according to claim 7, wherein the explosive wire tube is a steel tube.

11. The integrated hole sealing device for loosening blasting and water injection of underground deep hole according to claim 8, wherein the explosive wire tube is a steel tube.

12. The integrated hole sealing device for loosening blasting and water injection of underground deep hole according to claim 9, wherein the explosive wire tube is a steel tube.

* * * * *